US011440068B2

(12) United States Patent
Ruch et al.

(10) Patent No.: US 11,440,068 B2
(45) Date of Patent: Sep. 13, 2022

(54) PRESS MACHINE

(71) Applicant: Von Arx AG, Sissach (CH)

(72) Inventors: Matthias Ruch, Efringen-Kirchen (DE); Rudolf Kreuzer, Buchs (CH)

(73) Assignee: Von ARX AG, Sissach (CH)

( * ) Notice: Subject to any disclaimer, the term of this patent is extended or adjusted under 35 U.S.C. 154(b) by 31 days.

(21) Appl. No.: 16/250,019

(22) Filed: Jan. 17, 2019

(65) Prior Publication Data

US 2019/0217357 A1 Jul. 18, 2019

(30) Foreign Application Priority Data

Jan. 17, 2018 (EP) ..... 18152097

(51) Int. Cl.
*B21C 51/00* (2006.01)
*B21D 22/02* (2006.01)
(Continued)

(52) U.S. Cl.
CPC ..... *B21C 51/00* (2013.01); *B21D 22/025* (2013.01); *B21D 39/048* (2013.01); *B25B 27/10* (2013.01)

(58) Field of Classification Search
CPC ..... B21C 51/00; B25B 27/10; B25B 27/02; B25B 27/026; B21D 39/048;
(Continued)

(56) References Cited

U.S. PATENT DOCUMENTS 7,036,806 B2 * 5/2006 Amherd ..... B21D 39/048 269/3
2008/0024077 A1 * 1/2008 Bernier ..... B25B 27/10 318/115
(Continued)

FOREIGN PATENT DOCUMENTS

DE 102008024018 A1 11/2008
EP 2501523 9/2012
(Continued)

OTHER PUBLICATIONS

Examination report dated Mar. 19, 2020; Application KR 10-2019-000631; 17 pages. Eng translation p. 1-7.
(Continued)

*Primary Examiner* — Jessica Cahill
*Assistant Examiner* — Mohammed S. Alawadi
(74) *Attorney, Agent, or Firm* — Mark E. Bandy; Rankin Hill & Clark, ELP

(57) ABSTRACT

A pressing machine is described for plastically deforming a tubular workpiece, in particular a fitting. The pressing machine has a motor, and pressing jaws which are driven by the motor and can apply a force to the workpiece during operation. The pressing machine also has a power transmission unit coupled to the motor and the pressing jaws for transmitting power from the motor to the pressing jaws. The pressing machine also has at least one sensor unit for measuring at least one pressing parameter P and a controller which receives the currently measured value of the pressing parameter P from the sensor unit and determines therewith the pitch or slope of a press parameter curve K of the press parameter P. The controller terminates a pressing operation before reaching a maximum possible pressing force Pmax when the pitch or slope of the press parameter curve K of the press parameter P satisfies a shutdown criterion. Also described is a corresponding method for operating a pressing machine.

12 Claims, 3 Drawing Sheets

(51) Int. Cl.

| | |
|---|---|
| ***B21D 39/04*** | (2006.01) |
| ***B25B 27/10*** | (2006.01) |
| ***B25B 27/02*** | (2006.01) |
| ***B30B 1/32*** | (2006.01) |
| ***B30B 15/16*** | (2006.01) |
| ***B30B 15/26*** | (2006.01) |

(58) Field of Classification Search
CPC ... B21D 22/025; B25F 5/005; H01R 43/0428; B30B 15/16; B30B 15/166
See application file for complete search history.

(56) References Cited

U.S. PATENT DOCUMENTS

| | | | | |
|---|---|---|---|---|
| 2010/0300308 | A1* | 12/2010 | Frenken | B21D 39/048 100/35 |
| 2015/0068414 | A1 | 3/2015 | Nakano | |
| 2015/0251256 | A1* | 9/2015 | Frenken | H01R 43/0428 100/234 |
| 2016/0016222 | A1* | 1/2016 | Bungter | H01R 43/0428 29/515 |
| 2016/0023419 | A1* | 1/2016 | Frenken | B25B 27/10 100/35 |
| 2016/0252112 | A1* | 9/2016 | Kehoe | B25B 7/126 60/327 |
| 2016/0288193 | A1* | 10/2016 | Thorson | B25B 27/10 |
| 2016/0363510 | A1* | 12/2016 | Kanack | G01M 99/008 |
| 2017/0087709 | A1* | 3/2017 | Barezzani | B25B 27/146 |
| 2017/0252912 | A1* | 9/2017 | Barezzani | B25B 27/10 |
| 2018/0326600 | A1* | 11/2018 | Wason | B23D 29/002 |
| 2019/0030698 | A1* | 1/2019 | Frenken | B25F 5/005 |
| 2019/0061135 | A1* | 2/2019 | Cerfeuillet | G08B 5/36 |
| 2019/0308255 | A1* | 10/2019 | Wason | B26B 15/00 |
| 2019/0326720 | A1* | 10/2019 | Kelly | H01R 43/0585 |
| 2020/0001446 | A1* | 1/2020 | Ballard | F04B 17/03 |

FOREIGN PATENT DOCUMENTS

| | | |
|---|---|---|
| KR | 10-2008-0105938 | 12/2008 |
| KR | 10-2010-0021465 | 2/2010 |
| KR | 10-2016-0065060 | 6/2016 |
| WO | WO2016005838 | 1/2016 |

OTHER PUBLICATIONS

European Search Report dated Jul. 30, 2018; Application EP 18152097.4; 8 pages.

* cited by examiner

PRESS MACHINE

CROSS REFERENCES TO RELATED APPLICATIONS

This application claims priority from EP application serial No. 18152097.4 filed on Jan. 17, 2018.

FIELD

The present invention relates to a pressing machine, in particular a hand-held pressing machine, for pressing tubular workpieces, and a method for operating a pressing machine.

BACKGROUND

In the prior art, methods for pressing tubular workpieces, in particular pipes in installation technology, are known. In a known method, two pipes are non-detachably connected to one another by means of a press fitting. For this purpose, the pipes or tubes are inserted into openings of a press fitting which has polymer seals for sealing with the pipes. After insertion of the pipes to be joined, the press fitting is pressed by means of a suitable pressing machine, and plastically deformed so that the pipes can not be pulled out from the fitting and the seal seals securely.

The pressing is carried out with a hand-held and motor-driven pressing tool, which can have interchangeable tools, such as press jaws of different sizes and geometries. In addition, pressing tools are also known for other tasks, for example pressing tools are used for pressing, crimping or cutting workpieces, for example in the electrical industry.

In a hand-held press machine, the press jaws are placed around the press fitting for compression. When closing the pressing jaws, a force is exerted on the surface of the press fitting, so that the fitting is compressed and thereby plastically deformed, whereby the workpieces are securely joined together. Here, the inner tubes or pipes can undergo plastic deformation.

The pressing process is terminated in press machines of the prior art usually characterized in that when a certain maximum pressure is reached, a pressure relief valve is opened. The specified maximum pressure ensures that a suitably high pressing force has been exerted on the workpiece in order to ensure sufficient compression.

Thus, EP 2 501 523 B1 discloses a hand-held pressing device for pressing a press fitting in installation technology and for pressing cable lugs. To generate the required high pressing forces, the pressing tool is connected to an electro-hydraulic conversion device. The drive motor is a brushless electric motor. As soon as the required pressing force is reached, a pressure relief valve opens and the engine speed increases abruptly. This is detected by a control of the pressing device and the electric motor subsequently switched off.

However, the termination of the pressing operation by means of a permanently set pressure relief valve has the disadvantage that upon reaching the maximum pressure, the pressing jaws of the pressing tool already abut each other and no further deformation on the workpiece can take place. The fitting was previously compressed as much as possible during the pressing process and can no longer experience further plastic deformation. The direct pressing together of the dies leads naturally to a strong wear on the tool, the power transmission parts and the drive motor. In addition, unnecessary electrical energy is consumed.

It is therefore an object of the present invention to provide a press machine which overcomes the above problems and achieves a secure and durable press fit between tubular workpieces without causing unnecessary wear on the press machine and unnecessary power consumption. Furthermore, a corresponding method for operating a pressing machine is to be provided.

SUMMARY

In one aspect, the present invention provides a pressing machine for plastically deforming a workpiece. The pressing machine comprises a motor, pressing jaws which are driven by the motor and can apply a force to the workpiece during operation, and a power transmission unit coupled to the motor and the pressing jaws for transmitting power from the motor to the pressing jaws. The pressing machine also comprises at least one sensor unit for measuring at least one pressing parameter (P), and a controller which receives a currently measured value of the press parameter from the sensor unit and determines therewith a slope of a press parameter curve (K) of the press parameter (P). The controller terminates a pressing operation before reaching a maximum possible pressing force (Pmax) when the slope of the press parameter curve (K) of the pressing parameter (P) fulfills a switch-off criterion.

In another aspect, the present invention provides a method of operating a pressing machine for plastically deforming a tubular workpiece. The method comprises the following operations engaging the workpiece with pressing jaws of the pressing machine. The method also comprises starting a motor of the press machine to apply a force through the press jaws to the surface of the engaged workpiece. The method further comprises measuring a value of a press parameter (P). The method additionally comprises receiving a currently measured value of the press parameter (P) by the controller, and thereby determining a slope of a press parameter curve (K) of the press parameter (P). The method also comprises stopping the motor from reaching a maximum possible pressing force (Pmax) of the pressing machine by the controller when the controller detects that the slope of the press parameter curve (K) of the pressing parameter (P) is on switch-off criterion fulfilled.

The difficulties and drawbacks associated with previous approaches are addressed in the present subject matter as follows.

As will be realized, the subject matter described herein is capable of other and different embodiments and its several details are capable of modifications in various respects, all without departing from the claimed subject matter. Accordingly, the drawings and description are to be regarded as illustrative and not restrictive.

BRIEF DESCRIPTION OF THE DRAWINGS

Hereinafter, preferred embodiments of the present invention will be illustrated with reference to the accompanying drawings.

DETAILED DESCRIPTION OF THE EMBODIMENTS

Figure 1:
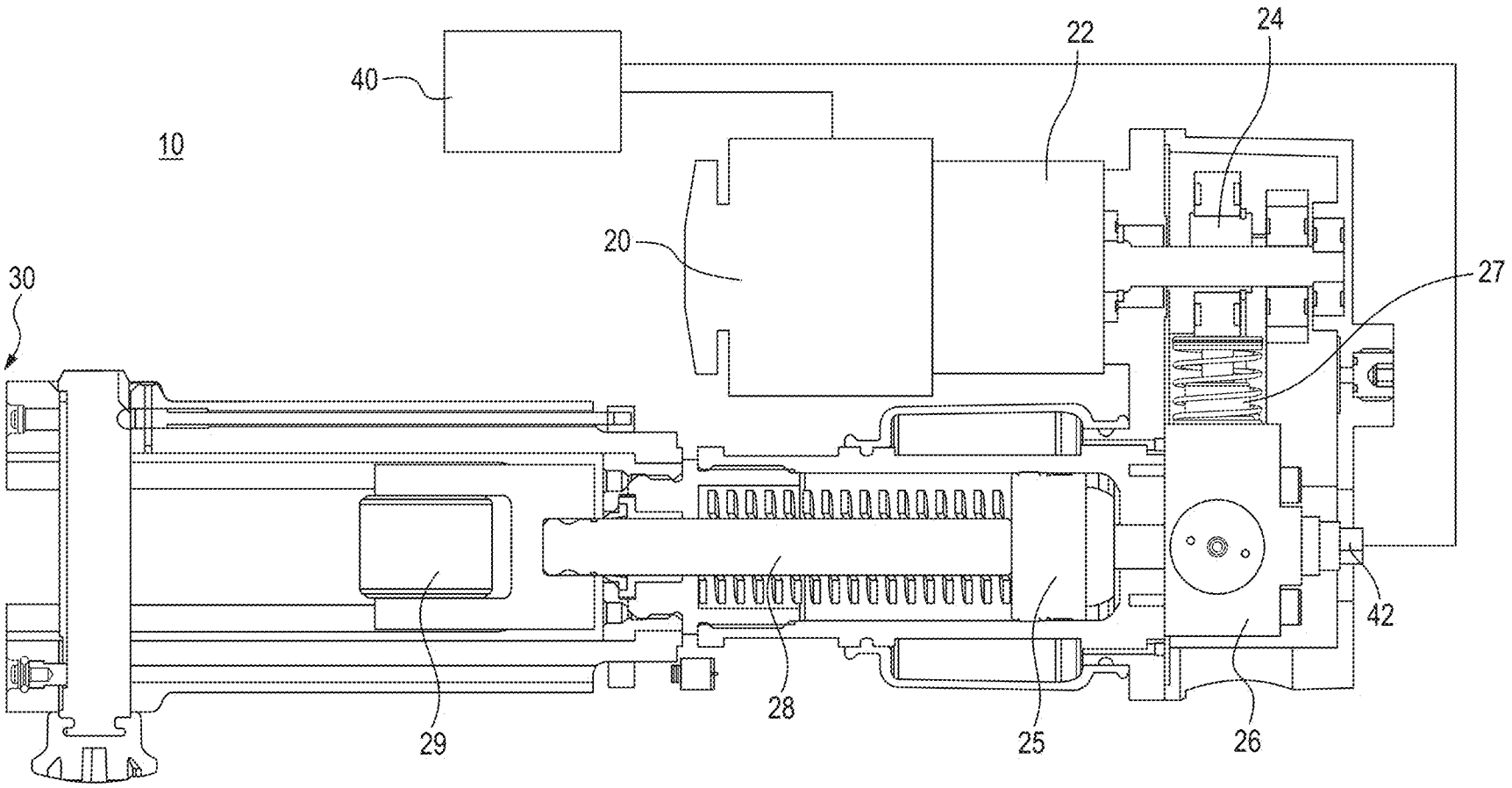
FIG. 1 is a schematic representation of an embodiment of the pressing machine as a hydraulic hand pressing device according to the present invention.

At least one of the above problems is solved according to the invention by a pressing machine and a method for operating a pressing machine as described herein.

In particular, at least one problem is solved by a pressing machine for plastically deforming a tubular workpiece, in particular a fitting, wherein the pressing machine has a motor, and pressing jaws, which are driven by the motor and can apply a force to the workpiece during operation. The pressing machine also has a power transmission unit, which is coupled to the motor and the press jaws for transmitting a force from the motor to the pressing jaws. The pressing machine also has at least one sensor unit for measuring at least one pressing parameter, and a controller which receives the currently measured value of the pressing parameter from the sensor unit utilizing a slope of a press parameter curve of the determined press parameter. The controller terminates a pressing operation before reaching a maximum possible pressing force when the slope of the press parameter curve of the press parameter meets a shutdown criterion.

In the present invention, the slope, i.e., the rise of a press parameter curve, is monitored, which results during the pressing process. The increase is characteristic for the increase of the pressing force on the workpiece with progressive pressing process. If the workpiece has reached the maximum deformation at the end and the pressing jaws of the pressing machine are completely closed, further increase in pressure results only in an elastic deformation of the pressing jaws. In this case, a purely linear increase in the values of a pressing parameter can be detected, e.g. in a hydraulic pressing device a purely linear increase in the pressure-time curve or current-time curve. This characteristic increase at the end of the pressing process is used by the controller to turn off the engine of the pressing machine before reaching a maximum possible pressing force and thus to end the pressing process.

The automatic termination of the pressing process before reaching the maximum possible pressing force of the machine due to the evaluation of the slope of at least one press parameter curve prevents further unnecessary pressing together of the pressing jaws, resulting in a reduction of the load and wear of the pressing jaws and other parts of the machine and saves energy and/or time. An additional interaction of a user to end the pressing process is not necessary.

The comparison of the slope of the press parameter curve of the measured values of the at least one pressing parameter with a switch-off criterion automatically takes into account the properties of the workpiece to be pressed, for example the material, the size, the design, etc. Thus, information or details of these properties is not required nor necessary before the respective pressing process. The switch-off criterion is independent of the individual properties of the workpiece to be pressed. Due to the monitoring of the slope of the press parameter curve, the controller can reliably finish the pressing operation after the plastic deformation of the workpiece, regardless of the level of the pressing force from which no further plastic deformation of the workpiece occurs.

During evaluation, one or more pressing parameters can be taken into account in any combination. The consideration of several pressing parameters at the same time strengthens the robustness of the analysis compared to so-called leaks, due to redundancy and/or random deviations.

Various sensors for measuring the same or different pressing parameters can be used for the evaluation with the present control.

The respective switch-off criterion can be adapted to the respective process parameter or to a combination of the process parameters.

Preferably, the switch-off criterion indicates that, with a continuation of the pressing process, only an elastic deformation on the pressing jaws occurs. This is the case when the pressing jaws are completely closed and no plastic deformation of the workpiece occurs. The switch-off criteria are preferably predetermined values of the slope for a specific press parameter curve, on the basis of which the controller can automatically decide when the current pressing operation is terminated.

Preferably, the power transmission unit is a hydraulic system and the sensor unit is a pressure sensor which measures the pressure in the hydraulic system as a press parameter. This makes it easy to adapt the control according to the invention to existing electro-hydraulic press machines. Via a pressure sensor, the hydraulic pressure can be measured simply and reliably as a process parameter and provided to the controller. The hydraulic pressure is directly proportional to the force applied to the tool pressing force, so that reliable determination of the force curve on the pressing jaws is possible via the hydraulic pressure.

If the power transmission unit is preferably a mechanical system, the sensor unit is a force sensor which measures the force at a location in the mechanical system as a press parameter. The control of the present invention can also be applied to pressing devices with a purely mechanical power transmission. In mechanical press machines, a force is transmitted from an engine to the press jaws via one or more power transmission units. In this case, the occurring force can be measured at different locations in the mechanical system. For this purpose, conventional load cells, strain gauges or similar sensors can be used. The measured force is usually also directly proportional to the pressing force applied to the tool, so that a reliable determination of the force curve on the pressing jaws is possible via the force measurement.

Preferably, a current flowing through the motor can continue to be used as the pressing parameter. This current can be measured by means of the controller, which then preferably also assumes the task of the sensor unit. From the current flowing through the motor, the force curve can also be derived at the press jaws.

Preferably, the control terminates the pressing process only when, in addition to the switch-off criterion, a predetermined minimum value for a pressing parameter (P) has been exceeded and/or when the duration of the pressing process has exceeded a minimum time. This does not take into account start-up effects at the beginning of the pressing process or areas of the pressing process in which a plastic deformation of the workpiece regularly takes place. This reduces the risk of incorrect measurements and an unwanted premature termination of the pressing process. Reliable compression of a workpiece usually requires a minimum pressing force achieved, so that no automatic termination of the pressing process should take place under this minimum pressing force.

Preferably, the slope of the press parameter curve indicates the time profile of the values of a press parameter and is preferably formed from the current and the time-preceding value of the press parameter. The consideration of the time profile of a press parameter is simply possible in the form of a time series, in particular if the slope of the process parameter curve is calculated from temporally successive measured values. Considering the current and previous value to determine the slope is simple and can be quickly implemented in a computational manner so that results can be real-time. Thereby, an immediate, timely control in response to the evaluation can be achieved. The significantly constant, linear course of the press parameter curve in the direct pressing together of the pressing jaws at the end of the pressing process, enables a robust and automatic detection of this pressing state.

Preferably, the controller may also have a database in which shutdown criteria for certain pressing jaws and/or workpieces are stored. The shutdown criteria here are preferably digital values of the slope of the process parameter curve in which an automatic shutdown is to take place. The database may contain values for shutdown criteria, which may depend on the properties of the press jaws used, such as material, size, type, etc.

Preferably, the pressing machine is an electrically driven hydraulic or mechanical hand pressing device for pressing tubular workpieces. With the help of a hand pressing device, pressings can be used flexibly at various locations, such as a construction site. In this case, electrically driven hand presses can apply high pressing forces, which ensure reliable pressing. In a hydraulic hand pressure device, for example, during operation, a hydraulic pressure up to about 550 bar can be applied, which acts directly on the workpiece enclosed by the pressing jaws.

At least one of the above-mentioned problems is also solved by a method for operating a pressing machine, for plastically deforming a tubular workpiece, in particular a fitting, the method comprising the following steps in the order given:

a. Engaging the workpiece with press jaws of the press machine;
b. Starting a motor of the pressing machine to apply a force through the pressing jaws to the surface of the engaged workpiece;
c. Measuring a value of a press parameter;
d. Receiving the currently measured value of the press parameter by the controller, and thereby determining the slope of a press parameter curve of the press parameter; and
e. Stopping the engine before reaching a maximum possible pressing force of the pressing machine by the controller when the control detects that the slope of the press parameter curve of the press parameter fulfills a switch-off criterion.

Preferably, the pressing parameter is a pressure, a force, or a current through the motor, or any combination of these parameters. These parameters are characteristic of the pressing pressure of the pressing machine.

The motor is preferably stopped only when, in addition to the switch-off criterion, a previously defined minimum value for a press parameter has been exceeded and/or when the duration of the press process has exceeded a minimum time.

Preferably, the method comprises the step of reading at least one switch-off criterion from a database of the controller. The switch-off criterion can be stored in a database in the control of the press machine and read, for example, suitable for the press jaws used and used in the control.

Hereinafter, preferred embodiments of the present invention will be described in detail with reference to the accompanying drawings.

FIG. 1 shows an embodiment of a hydraulic manual press device 10 with a hydraulic power transmission unit. The hydraulic manual press device 10 is driven by a motor 20 via a transmission or gear 22, and includes an eccentric 24 or cam connected thereto. Preferably, the motor 20 is a brushless motor powered by a controller 40 with a correspondingly modulated current from a battery or a wired power supply (not shown). The transmission 22 reduces the speed of the motor 20 and increases the torque. The eccentric 24 connected to the transmission converts the rotational movement of the output shaft of the transmission 22 into a one-dimensional oscillating motion to drive a piston pump 27 of the hydraulic system 26.

The piston pump 27 pumps to move a hydraulic fluid from a reservoir into a working cylinder 25, whereby the hydraulic pressure in the working cylinder 25 increases. The increasing hydraulic pressure pushes a piston 28 movably guided in the cylinder in the illustration of FIG. 1 to the left, in the direction of the fastening region for exchangeable pressing jaws 30 (not shown in detail). By using a large piston diameter, the piston 28 can transfer very high pressures to the dies.

The piston 28 is mechanically connected to rollers 29, which move with the movement of the piston 28. The rollers 29 move in a conventional manner between inclined ends of pressing jaws 30, which are thus closed and can plastically deform the workpiece with high force. In operation, this transfers the hydraulic pressure directly proportional to the connected pressing jaw 30, and generates a pressing force F directly proportional to the hydraulic pressure on the workpiece. The pressure on the workpiece is directly proportional to the hydraulic pressure.

As a result of the increasing hydraulic pressure P during pressing and the thus increasing pressing force F on the workpiece or the fitting, the workpiece is pressed and plastically deformed. By measuring the hydraulic pressure P, the pressing force F on the tool can be determined.

The hydraulic pressure P in the hydraulic system 26 can be easily measured by means of a pressure sensor 42. The pressure sensor 42 communicates the measured pressure signal to the controller 40 via signal lines or wirelessly by means of a corresponding radio transmission. Wireless signal transmission means, such as common digital wireless connections such as e.g. Bluetooth, NFC or the like can be used. Analog signals from the pressure sensor 42 can be converted into digital signals in an A/D converter so that they can be evaluated by the digital controller 40.

The controller 40 has for this purpose at least one digital processing unit, such as a microcontroller, DSP, FPGA, ASIC or the like. In addition, the control unit may have a database (not shown) stored on data storage devices in which predetermined values required for the evaluation can be retrieved.

Depending on the evaluation results, the controller 40 via control electronics (not shown) generates corresponding control signals to the motor 20. The motor 20 is controlled by means of these control signals to operate at a certain regulated speed and stop at the end of the pressing process.

In another embodiment, not shown, the pressing machine may also be designed as a purely mechanical hand pressing device with a mechanical power transmission unit. In a mechanical hand press, a motor generates a rotational movement, which is transmitted via a transmission to at least one mechanical power transmission unit, for example a lever or a screw drive. The mechanical power transmission unit converts the rotary motion into a linear motion which, in accordance with the hydraulic hand press apparatus 10 of FIG. 1 described above, displaces high force rollers that move the press jaws. Due to the increasing force of the pressing jaws, a workpiece, for example a fitting that is located between the pressing jaws, is plastically deformed.

Force sensors, for measuring the force F transmitted to the tool by the motor, may be located at various locations in the mechanical hand press to measure a force proportional to the pressing force F and to signal the force to the controller.

Furthermore, the current absorbed by the motor 40 also behaves proportional to the motor torque and thus to the pressing force F on the pressing jaws.

Figure 2:
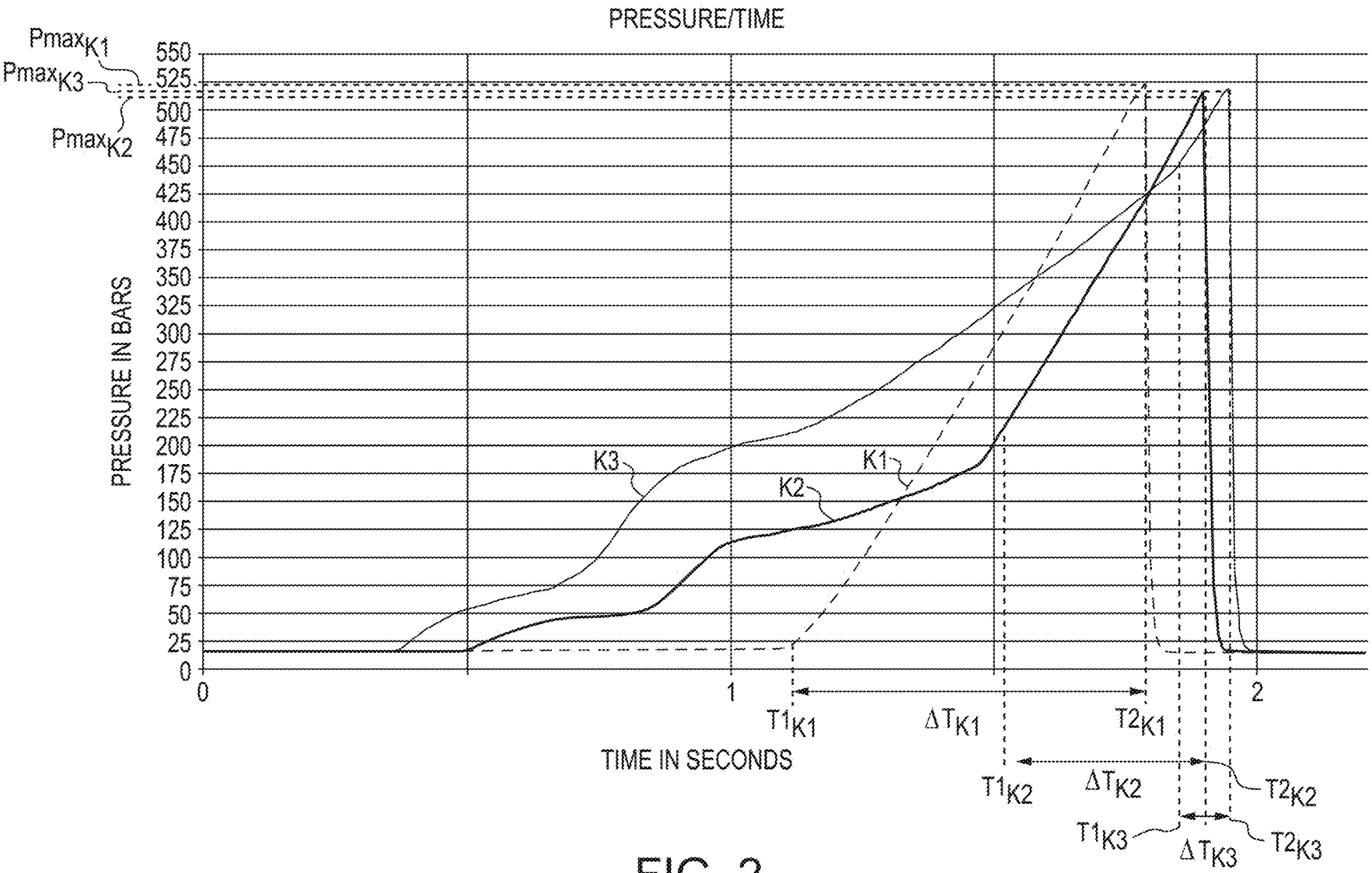
FIG. 2 shows a diagram of press parameter curves for different press jaws and materials to be pressed in a press machine according to the prior art.

FIG. 2 shows a graphical representation of measured press parameter curves K1, K2 and K3 of prior art presses representing hydraulic pressure values P over time. The press parameter curve K1 was recorded during pressing without a fitting inserted between the press jaws, i.e., at "empty" press jaws. The press parameter curve K2 was recorded when pressing a fitting made of a first material with the same pressing jaws as curve K1. The material of the fitting was a comparatively soft material, such as copper.

The press parameter curve K3 was recorded during the compression of a fitting made of a second material. The material of this fitting had a greater strength than in curve K2 and is stainless steel in one embodiment.

In FIG. 2 it can be seen that in curve K1, the pressure at the beginning is relatively constant and almost zero, since when closing the pressing jaw there is no fitting between the press jaws. The press jaws can close unhindered at a minimum hydraulic pressure, which overcomes the friction and spring forces in the system. From the time T1K1 the pressing jaws are completely closed and lie against each other. From this point on the press directly against each other, whereby the press parameter curve K1 shows a constant linear increase ΔTK1 until the maximum pressure PmaxK1 is reached. When the maximum pressure PmaxK1 is reached, an overpressure valve opens, causing the hydraulic pressure to abruptly drop to a minimum pressure. As can be seen from the press parameter curve K1, the press jaws therefore show a linear elastic deformation in the fully closed state. This feature of the die jaws utilizes the present invention to automatically detect the end of the pressing operation and then shut off the engine 20 before the maximum pressure PmaxK1 is reached. This protects the entire pressing machine and reduces the energy required.

The curve of the press parameter curve K2 shows an earlier hydraulic pressure increase than the press parameter curve K1, since there is a fitting made of a soft material between the press jaws. From the time T1K2 the press parameter curve K2 in turn increases linearly, since at this time the actual pressing process is completed, the fitting was completely plastically deformed and the pressing jaws are completely closed and rest against each other. The linear increase ΔTK2 occurs with a substantially same slope as that of the curve K1. When the maximum pressure PmaxK2 is reached, the overpressure valve opens again at the time T2K2 and the curve K2 drops very quickly to a minimum pressure.

The press parameter curve K3 increases more than the press parameter curve K2 due to the harder material of the fitting to be pressed. Furthermore, a higher overall pressure must be applied to the curve K3 than to the curve K2 in order to close the pressing jaws and completely plastically deform the fitting. At time T1K3, the curve of K3 becomes linear, indicating the end of the actual pressing operation and signaling that the pressing jaws are completely closed and abutting one another. As can be seen, the slope of the linear region ΔTK3 substantially corresponds to the slope of the linear regions ΔTK1 and ΔTK2. This slope of the press parameter curve is therefore a characteristic measure of the end of the actual pressing process on the workpiece.

As can be further seen from FIG. 2, the time period ΔTK1 is significantly greater or longer than the time period ΔTK2 of the curve K2 or the time period ΔTK3 of the curve K3. The longer the time interval ΔT, the longer the pressing jaws of the hand press device lie directly on one another and press directly against one another. During the time period ΔT no plastic deformation of the workpiece or fitting takes place and so the pressing force F is unnecessarily increased in this period.

The curves K1, K2 and K3 would be correspondingly given if, instead of the hydraulic pressure over time, a force acting mechanically in the system or the current through the motor 20 were plotted over time. Again, from a linear increase of the curve with a characteristic slope, the end of the pressing process and the juxtaposition of the pressing jaws can be seen.

Figure 3:
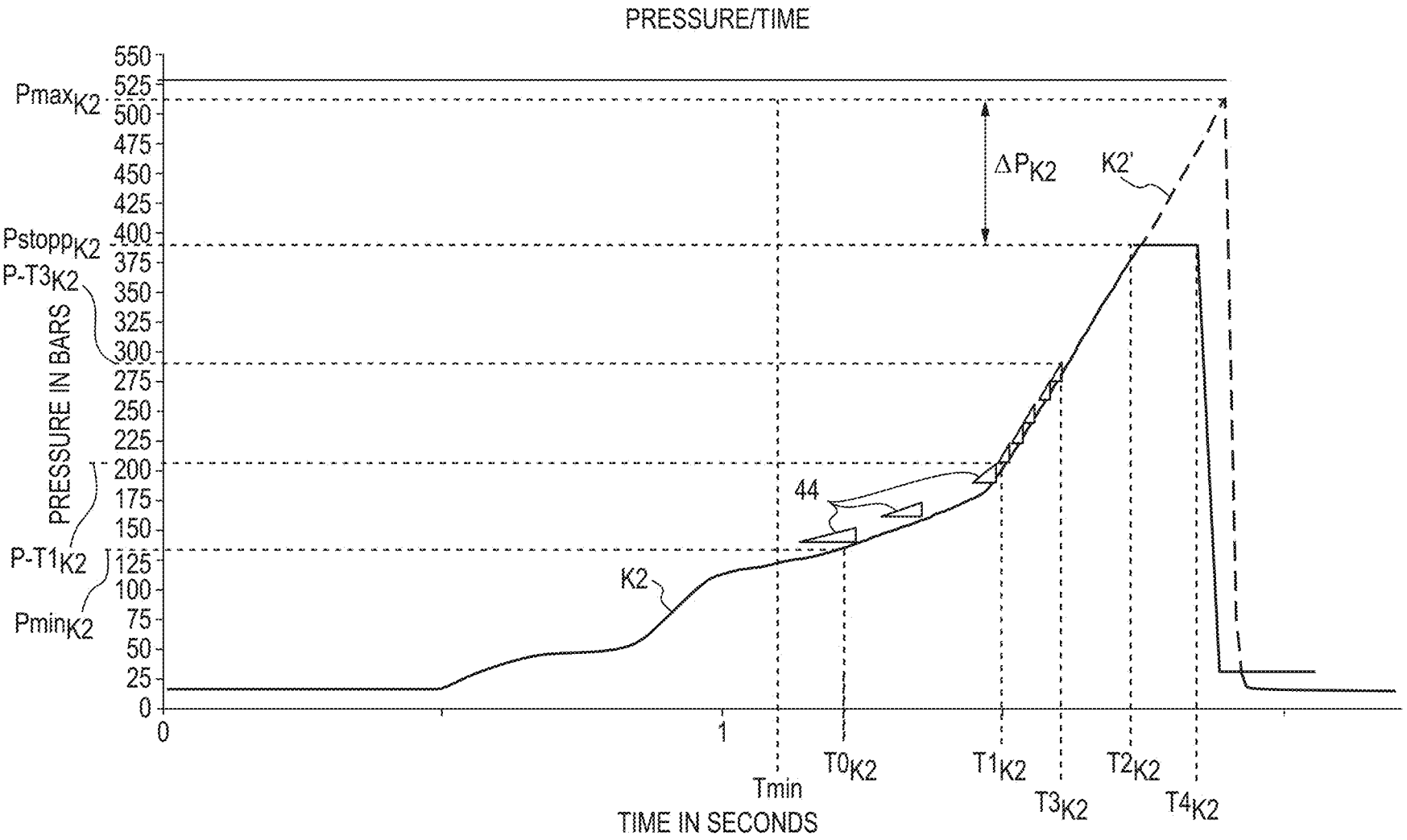
FIG. 3 shows a chemical representation of the evaluation of a press parameter curve according to the present invention.

FIG. 3 shows an example of the curve of the press parameter curve K2, if now a controller 40 according to the invention is used. In this case, the controller 40 determines the slope of the press parameter curve K2 and can recognize from this whether the actual pressing process is completed on the workpiece. Here, the controller 40 compares the slope of the press parameter curve K2 with a switch-off criterion, i.e., in the present case a characteristic pitch of the press jaws used in the fully closed state. If the slope satisfies the switch-off criterion, which the control determines or calculates, it ends the pressing process by switching off the motor 20 or not supplying any further power. Thus, the controller 40 can finish the pressing operation reliably, before unnecessarily a maximum possible pressing force Pmax is reached. This significantly reduces the wear in the press, the energy required and the time required. The savings are greater when pressing softer fittings than when pressing harder fittings.

The shutdown of the motor 20 can be made dependent on the controller 40 in addition to other conditions, such as to detect outliers of a press parameter curve and exclude such. Thus, in addition to the switch-off criterion, it may be necessary for a switch-off of the motor 20 if a previously defined minimum value for a pressing parameter P has been exceeded and/or if a duration of the pressing process has exceeded a minimum time Tmin.

In the example of the curve K2 of FIG. 3, the minimum value is a minimum pressure PminK2, which defines a time T0K2, from which the controller 40 for each measured press parameter valve, detects a rise (represented by a slope triangle 44) between the current and the previous value determined and compared to the shutdown criterion. The minimum pressure Pmin may be generally fixed, or may be variable, e.g. depending on the used press jaws or the workpiece. Equivalent parameters, for example, a minimum current at the motor 20 can be used as a criterion for the time TO.

However, it is also possible to specify a minimum time Tmin which the pressing process must take at least before the controller can switch off the motor 20.

From time T1K2, the slope value determined by the controller 40 coincides with a predetermined slope value stored in the database of the controller 40 as the switch-off criterion. From this point in time T1K2 on, the controller 40 then preferably determines the number of rise values which are the same in a time range.

At the later time T3K2, a predetermined number of increases with equal slope values were then counted. The counted rise values are essentially the same as the predefined rise value stored in the database. Permissible tolerances of the slope values can be determined empirically and stored in the controller 40.

In the example of FIG. 3, a certain predetermined number of slope values of the pressing parameter P of the curve K2 serve as a shutdown criterion by way of example. Wherein this switch-off criterion is met in the present embodiment at the time T3K2. The pressing operation is then stopped by the controller 40. However, for this purpose, the controller 40 and the engine require a reaction time between the times T3K2 and T2K2. At the time T2K2, the engine 20 and the hydraulic pressure Pstopp K2 remains constant. After a further reaction period between the times T2K2 and T4K2, the pressure relief valve or a return valve is opened by the controller 40 at the time T4K2, as a result of which the hydraulic pressure in the hydraulic system of the pressing device drops to a minimum or nominal value.

In FIG. 3 by means of dashed line K2' for comparison, the curve of the press parameter curve K2 is shown according to the prior art without the control according to the invention. Without the control according to the invention, as shown in FIG. 2, the pressing process would take place until a maximum pressure PmaxK2 is reached. Only when this maximum pressure PmaxK2 is reached would the overpressure valve open and the hydraulic pressure would drop to a minimum value, whereby the pressing process would not be completed until the overpressure valve was opened.

From FIG. 3, a pressure difference ΔPK2 is further seen, which extends between the pressure when switching off the motor PstoppK2 and the set maximum pressure PmaxK2 (overpressure protection). This pressure difference ΔPK2 represents the saved pressure, otherwise applied by the engine 20. At the same time, the pressure difference ΔPK2 also represents the energy saved with the present invention, since the engine does not have to do any work after it is switched off at time T2. The greater the pressure difference ΔP the more effective the saving is by the present invention. The savings will be greater in soft workpieces, as in harder workpieces, as shown in FIG. 2.

| LIST OF REFERENCE NUMBERS | |
|---|---|
| 10 | Hydraulic hand press |
| 20 | Motor |
| 22 | Gear |
| 24 | Eccentric |
| 25 | Working cylinder |
| 26 | Hydraulic system |
| 27 | Piston pump |
| 28 | Piston |
| 29 | Rollers |
| 30 | Mounting area for replaceable tools |
| 40 | Controller |
| 42 | Pressure sensor |
| 44 | Ascertained increase (shown as gradient triangle) |
| $K_1$, $K_2$, $K_3$ | Parameter curves |
| $K_2$' | Non-inventive course of the parameter curve $K_2$ |
| Pmin ($K_2$) | Minimum pressure in $K_2$ for shutdown |
| Pmax ($K_1$, $K_2$, $K_3$) | Maximum applicable pressure in $K_1$, $K_2$, $K_3$ |
| P-$T_1$ ($K_2$) | Pressure in $K_2$ at time $T_1$ |
| P-$T_3$ ($K_2$) | Pressure at time $T_3$ |
| Pstopp ($K_2$) | Pressure at the moment when pressing is stopped |
| ΔP ($K_2$) | Pressure difference in $K_2$ |
| Tmin | Minimum time for shutdown |
| $T_0$ ($K_2$) | Time $T_0$: Start of test for switch-off criterion |
| $T_1$ ($K_1$, $K_2$, $K_3$) | Time $T_1$: start of the constant linear slope |
| $T_2$ ($K_1$, $K_2$, $K_3$) | Time $T_2$: End of the pressing process |

-continued

| LIST OF REFERENCE NUMBERS | |
|---|---|
| $T_3$ ($K_2$) | Time $T_3$: Switch-off criterion fulfilled |
| $T_4$ ($K_2$) | Time $T_4$: Opening of pressure relief valve or return |
| ΔT ($K_1$, $K_2$, $K_3$) | Time difference between T1 and T2 (duration of constant linear slope) |

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A pressing machine for plastically deforming a workpiece, wherein the pressing machine comprises:

a motor;

pressing jaws which are driven by the motor and can apply a force to the workpiece during operation;

a power transmission unit coupled to the motor and the pressing jaws for transmitting power from the motor to the pressing jaws;

at least one sensor unit for measuring at least one pressing parameter (P); and a controller which receives a currently measured value of the pressing parameter from the sensor unit and checks if a predetermined minimum value (Pmin) is exceeded for the pressing parameter (P) and checks if the duration of the pressing operation exceeds a minimum time (Tmin); and if one of the pressing parameter (P) exceeds the predetermined minimum value (Pmin) and the duration of the pressing operation exceeds the minimum time (Tmin), subsequently the controller determines a slope of a pressing parameter curve (K) of the pressing parameter (P); in which the controller terminates a pressing operation before reaching a maximum possible pressing force (Pmax) when the slope of the pressing parameter curve (K) of the pressing parameter (P) fulfills a switch-off criterion.

2. The press machine according to claim 1, wherein the switch-off criterion indicates that only an elastic deformation on the pressing jaws occurs in a continuation of the pressing operation.

3. The press machine according to claim 1, wherein the power transmission unit is a hydraulic system, and the sensor unit is a pressure sensor, which measures a pressure in the hydraulic system as a pressing parameter (P).

4. The pressing machine according to claim 1, wherein the power transmission unit is a mechanical system, and the sensor unit is a force sensor which measures a force at a location in the mechanical system as a pressing parameter (P).

5. The pressing machine according to claim 1 wherein the pressing parameter (P) is a current flowing through the motor.

6. The press machine according to claim 1, wherein the slope of the pressing parameter curve (K) indicates the time course of the values of a pressing parameter (P).

7. The pressing machine according to claim 6 wherein the pressing parameter curve (K) is formed from the current and the temporally preceding pressing parameter value.

8. The pressing machine according to claim 1, wherein the controller has a database that stores at least one shutdown criteria for certain pressing jaws and/or workpieces.

9. The press machine according to claim 1, wherein the pressing machine (10) is an electrically driven hydraulic or mechanical hand pressing device for pressing tubular workpieces.

10. A method of operating a pressing machine for plastically deforming a tubular workpiece, the method comprising the following operations performed in sequential order:

engaging the workpiece with pressing jaws of the pressing machine;

starting a motor of the press machine to apply a force through the press jaws to the surface of the engaged workpiece;

measuring a value of a pressing parameter (P);

receiving a currently measured value of the pressing parameter (P) by a controller, the controller checking if a predetermined minimum value (Pmin) is exceeded for a pressing parameter (P) and checking if the duration of the pressing operation exceeds a minimum time (Tmin); and if one of the pressing parameter (P) exceeds the predetermined minimum value (Pmin) and the duration of the pressing operation exceeds the minimum time (Tmin), subsequently determining by the controller a slope of a pressing parameter curve (K) of the pressing parameter (P); and stopping the motor from reaching a maximum possible pressing force (Pmax) of the pressing machine by the controller when the controller detects that the slope of the pressing parameter curve (K) of the pressing parameter (P) fulfills a switch-off criterion.

11. The method according to claim 10, wherein the pressing parameter (P) is a parameter selected from the group consisting of a pressure, a force, a current through the motor, and a combination of these parameters.

12. The method according to claim 10, further comprising the following operation:

reading at least one switch-off criterion from a database of the controller.

* * * * *